US005460218A

United States Patent [19]

Miwa et al.

[11] Patent Number: 5,460,218

[45] Date of Patent: * Oct. 24, 1995

[54] METHOD FOR DISCHARGING GAS OUT OF METAL MOLDS AND APPARATUS THEREFOR

[75] Inventors: Tomoyoshi Miwa; Noriyoshi Yamauchi; Hitoshi Ishida, all of Fuchu, Japan

[73] Assignee: Ryobi Ltd., Tokyo, Japan

[ * ] Notice: The portion of the term of this patent subsequent to Jan. 10, 2012 has been disclaimed.

[21] Appl. No.: 155,330

[22] Filed: Nov. 22, 1993

[30] Foreign Application Priority Data

Nov. 25, 1992 [JP] Japan ..... 4-338077

[51] Int. Cl.[6] ..... B22D 17/32

[52] U.S. Cl. ..... 164/61; 164/65; 164/305; 164/113

[58] Field of Search ..... 164/113, 61–65, 164/305

[56] References Cited

FOREIGN PATENT DOCUMENTS 0475645 3/1992 European Pat. Off. .
4123463 1/1993 Germany .

OTHER PUBLICATIONS

Patent Abstracts of JapaN, vol. 9, No. 286, 13 Nov. 1985 (JPA 60 127 063, 6 Jul. 1985).
Patent Abstracts of Japan, vol. 7, No. 183, 12 Aug. 1983 (JA 58 084 658, 20 May 1983).
Patent Abstracts of Japan, vol. 9, No. 117, 22 May 1985 (JA 60 003 959, 10 Jan. 1985).

*Primary Examiner*—Kuang Y. Lin
*Attorney, Agent, or Firm*—Sughrue, Mion, Zinn, Macpeak & Seas; Richard C. Turner; Marie-Claire Boisvert

[57] ABSTRACT

A method and apparatus capable of continuously discharging contaminated gas out of metal molds, the gas being generated prior to the casting step and including moisture. A gas vent valve is provided at a gas vent passage in communication with a mold cavity. A suction unit and a vacuum pump are selectively connected to the gas vent valve. After closure of the metal molds, the suction unit is connected to the gas vent valve to perform sucking interior of the mold cavity. By this suction, an external air is introduced into the metal molds through a pouring port of a shot sleeve. Thus, contaminated gas in the cavity is replaced with a clean air. During injection molding, the gas vent valve is connected to the vacuum pump for decompressing the mold cavity. Vapor explosion is avoidable since moisture content is removed from the mold cavity even if the molten metal is introduced into the cavity.

7 Claims, 2 Drawing Sheets

METHOD FOR DISCHARGING GAS OUT OF METAL MOLDS AND APPARATUS THEREFOR

BACKGROUND OF THE INVENTION

The present invention relates to a method and apparatus for discharging gas out of metal molds, and more particularly to such method and apparatus in a die-casting.

A gas discharging technique has been conventionally proposed for removing gas from metal molds in order to produce a voidless casted product by an injection molding apparatus. To this effect, a gas vent valve is provided for selectively communicating a mold cavity with atmosphere. For example, Japanese Utility Model Application Kokai No. Sho. 61-195853 discloses a technique in which a vacuum pump is connected to the gas vent valve for decompressing the mold cavity during injection molding to suck gas from the cavity. In die-casting, cooling water is sprayed onto the metal molds after opening of the metal molds for cooling the same, and release agent is coated on surfaces of the metal molds.

However, if the metal molds still have high temperature after closure of the metal molds, the release agent in the metal molds or residual cooling water may be converted into contamination gas. If molten metal is poured into a shot sleeve in accordance with an injection start signal, the generation of the contamination gas is greatly promoted due to high temperature of the molten metal. Since the contamination gas contains water content, vapor explosion may occur during filling of the molten metal into the metal molds to degrade fluidity thereof, which causes gas involvement and insufficient run, to thus produce low grade product.

In order to overcome these drawbacks, according to a Japanese Patent Application Kokai No. sho.60-127063, hot air is supplied into the metal molds through the gas vent valve for escaping the gas in the metal molds through a pouring port of the shot sleeve.

However,in the Japanese Patent Application Kokai No. sho.60-127063, contamination gas cannot be sufficiently discharged out of the pouring port, since the gas in the metal molds are scattered in all directions when pressurized hot air is blown thereinto. Further, there are insufficient gas escaping routes in a metal mold portion where a blind alley or dead-end street are provided like a by-pass passage, which in turn makes gas discharge difficult. In an actual casting, the hot air blowing must be terminated before the molten metal is poured into the shot sleeve. However, residual water or oil non-vapored may be vapored and filled in the metal molds after termination of the hot air blowing.

A Japanese Patent Application Kokai No. sho.58-84658 discloses a vacuum die-casting method. The method includes scavenging step where air is introduced into the metal molds through a pouring port of an injection cylinder because of the application of negative pressure by way of a vacuum tank while the gas vent valve is open and concurrently with the closure of the metal molds. The method also includes the steps of filling the molten metal into the metal molds, and a vacuum casting step where the gas vent valve is again open for a predetermined period after the pouring port is closed by a plunger tip to perform casting.

Further, a Japanese Patent Application Kokai No. sho.60-3959 discloses sealingly maintaining a mold cavity in a decompressed state and forcibly discharging gas from the mold cavity until termination of casting in order to remove gas from the mold cavity, the gas being generated at the time of casting on the premise of employment of a cavity produced by casting sands. To be more specific, a discharge hole connected to a discharging blower is formed at an upper portion of the cavity, and an open end portion of a pouring port is covered with a meltable thin plate. Further, a riser port is formed at the upper portion of the cavity, and the opening of the riser port is covered with the meltable plate. Thus, the cavity is sealed by the thin plate. With this state, decompression to the cavity is performed by operating the discharging blower. During decompression, when high temperature molten metal is poured through the pouring port, the thin plate is melted so that the molten metal can flow into the cavity. When the molten metal is brought into contact with the thin plate on the riser port, the plate is melted to complete casting.

However, in the Japanese Patent Application Kokai No. sho.60-127063, contamination gas cannot be sufficiently discharged out of the pouring port, since the gas in the metal molds are scattered in all directions when pressurized hot air is blown thereinto. Further, there are insufficient gas escaping routes in a metal mold portion where a blind alley or dead-end street are provided like a by-pass passage, which in turn makes gas discharge difficult. In an actual casting, the hot air blowing must be terminated before the molten metal is poured into the shot sleeve. However, nonvapored residual water or oil may be vapored and filled in the metal molds after termination of the hot air blowing.

Further, in the Japanese Patent Application Kokai No.58-84658, gas discharge from the metal molds is performed through suction by a vacuum tank during a scavenging step, and therefore, pressure in the vacuum pump will be increased. Then, the pressure in the vacuum tank must be reduced for performing vacuum suction in the subsequent vacuum casting step. However, if the gas discharge is fully performed in the scavenging step, a large pressure increase occurs in the vacuum tank, and therefore, a relatively long period is required for reducing the pressure in the vacuum tank until start of the vacuum casting in the vacuum casting step. Consequently, the shot cycle is disadvantageously prolonged. Furthermore, after the molten metal is poured through the pouring port into the casting sleeve and the plunger tip closes the pouring port, scavenging cannot be performed. As a result, contamination gas generated by the heat from the molten metal is filled in the metal molds, and the gas cannot be scavenged.

Furthermore, it would be difficult to apply the invention described in the Japanese Patent Application Kokai No.Sho 60-3959 into the die-casting technique. That is, in the die-casting, there are provided the pouring port and gaps between the metal molds, and external cooling water and release agent will be converted into gas, which are filled in the metal molds after closure thereof. In this connection, it would be difficult to maintain decompressed pressure in the mold cavity. Moreover, in the invention described in the above publication, attention is not drawn to the contamination gas existing in the mold cavity before casting, but the decompression and forcible gas discharge are performed so as to discharge gas generated during the casting. It would be structurally impossible to substitute clean air for the contamination gas which has been filled in the mold cavity prior to the casting.

SUMMARY OF THE INVENTION

Therefore, it is an object of the present invention to provide a method and apparatus for discharging gas from the metal molds, in which contamination gas filled in the mold cavity prior to casting can be continuously discharged and replaced by fresh gas, and gas involvement and insufficient run due to the gas generated during casting are avoided.

To attain the above described object, the present invention provides a method for discharging gas out of metal molds including the step of opening a gas vent valve provided in a gas vent passage in communication with a mold cavity formed in the metal mold, and decompressing the mold cavity through a first suction means through the gas vent valve for discharging gas in the mold cavity to avoid gas involvement in a molten metal injected in the mold cavity, and the improvement comprising the steps of venting the mold cavity by second suction means independent of the first suction means through the gas vent valve after closure of the metal molds and until the decompression step is started for removing contaminated gas from the metal molds and replacing the contaminated gas with a fresh air at a phase prior to the injection of the molten metal.

The present invention further provides an apparatus for discharging gas out of metal molds having a mold cavity, a gas vent passage in communication with the mold cavity, and a gas vent valve disposed in the gas vent passage, the apparatus including first suction means for sucking a gas in the mold cavity through the gas vent valve, and the improvement comprising second suction means and control means. The second suction means is provided independent of the first suction means. The second suction means is connected to the gas vent valve for forcibly venting the mold cavity by sucking a gas in the metal molds. The control means is connected to the first and second suction means for operating the first suction means immediately after the forcible venting operation by the second suction means.

According to the method and apparatus for discharging gas out of the metal molds, after the closure of the metal molds, contamination gas generated in the metal molds are continuously and forcibly discharged by the second suction means. Therefore, air can be introduced through the pouring port of the shot sleeve. Thus, the mold cavity is filled with clean air. Accordingly, in the subsequent step, vapor explosion is avoidable when the molten metal is filled in the mold cavity. Because of the filling of the molten metal into the mold cavity, newly contaminated gas may be generated. However, the contaminated gas is removed in the decompression step. Consequently, gas involvement and insufficient run can be restrained in a minimum level. In other words, in the present invention, contamination gas existing in the mold cavity prior to the casting is forcibly discharged, to thus discharge the contamination gas out of the mold cavity as much as possible in one shot cycle.

DETAILED DESCRIPTION OF THE PREFERRED EMBODIMENTS

Figure 1:
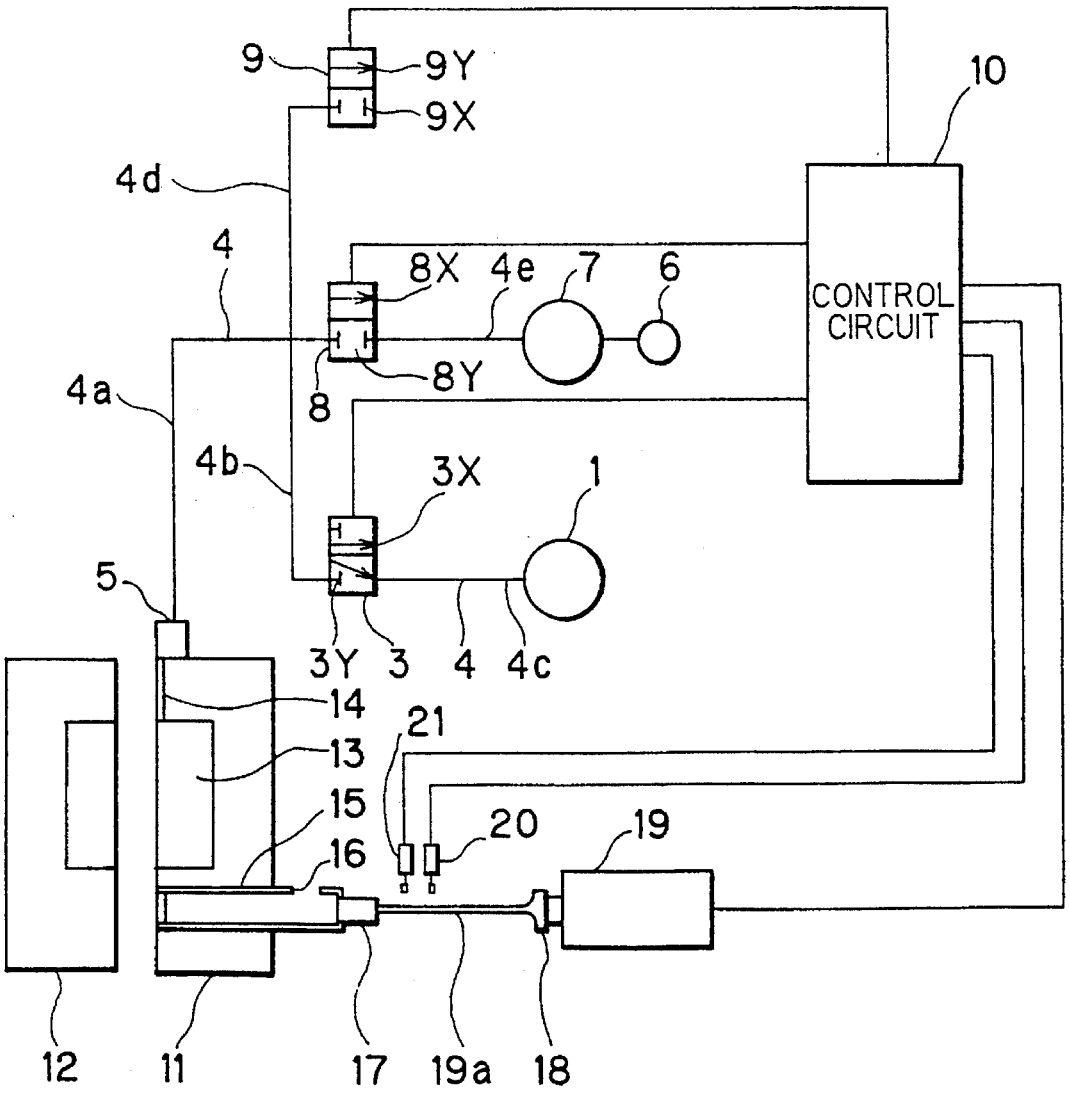
FIG. 1 is a schematic view showing an apparatus for discharging gas out of metal molds for embodying a method for discharging the gas according to one embodiment of the present invention.

An apparatus for discharging gas out of metal molds according to one embodiment of the present invention will be described with reference to FIG. 1.

A casting machine such as a die-casting machine includes a stationary metal mold 11 and a movable metal mold 12 movable relative to the stationary metal mold 11. A mold cavity 13 is defined between the molds 11 and 12. A shot sleeve 15 having a pouring port 16 is provided in communication with the mold cavity 13, and a plunger tip 17 is slidably disposed in the shot sleeve 15. The plunger tip 17 is driven by an injection cylinder 19 through a cylinder rod 19*a* to which a striker 18 is provided. The striker 18 is provided abuttable on a vacuum start limit switch 20 and a high speed limit switch 21 during moving stroke of the cylinder rod 19*a*. These limit switches 20, 21 are connected to a control circuit 10.

The gas discharging apparatus is adapted for discharging gas existing in the metal molds or generated at the casting out of the metal molds by the application of negative pressure. The gas discharging apparatus includes a gas vent valve 5 connected to a gas vent passage formed in the stationary metal mold 11 and communicated with the mold cavity 13, a first electromagnetic valve 8 connected to the gas vent valve 5, a vacuum tank 7 connected to the first electromagnetic valve 8, and a vacuum pump 6 connected to the vacuum tank 7. These are connected to each other by gas exhaust line 4 (4*a*, 4*e*). The first electromagnetic valve 8 is connected to the control circuit 10 which is adapted to generate change-over signals for moving the first electromagnetic valve 8 into a first change-over position 8X where the vacuum tank 7 is communicated with the gas vent valve 5, and for moving the first electromagnetic valve 8 into a second change-over position where the gas vent valve is shut off from the vacuum tank 7.

A metal molds venting device generally includes second and third electromagnetic valves 3, 9, and a suction unit (blower) 1. The second electromagnetic valve 3 is connected to the gas vent valve 5 by way of the gas exhaust line 4 (4*a*, 4*b*), and the suction unit 1 is connected to the second electromagnetic valve 3 by way of the gas exhaust line 4 (4*c*). The second electromagnetic valve 3 is connected to the control circuit 10 which generates signals for moving the second electromagnetic valve 3 into a first change-over position 3X where the gas vent valve 5 is communicated with the suction unit 1, and into a second change-over position 3Y where communication therebetween is shut off. Further, the third electromagnetic valve 9 is connected to the gas vent valve 5 through the gas discharge line 4 (4*a*, 4*d*) at a position upstream of the first and second electromagnetic valves 8, 3. The control circuit 10 transmits signals to the third electromagnetic valve 9 for moving the same to its first change-over position 9X where communication between the gas exhaust line 4 and an atmosphere is blocked and to its second change-over position 9Y where the gas exhaust line 4 is communicated with the atmosphere.

Figure 2:
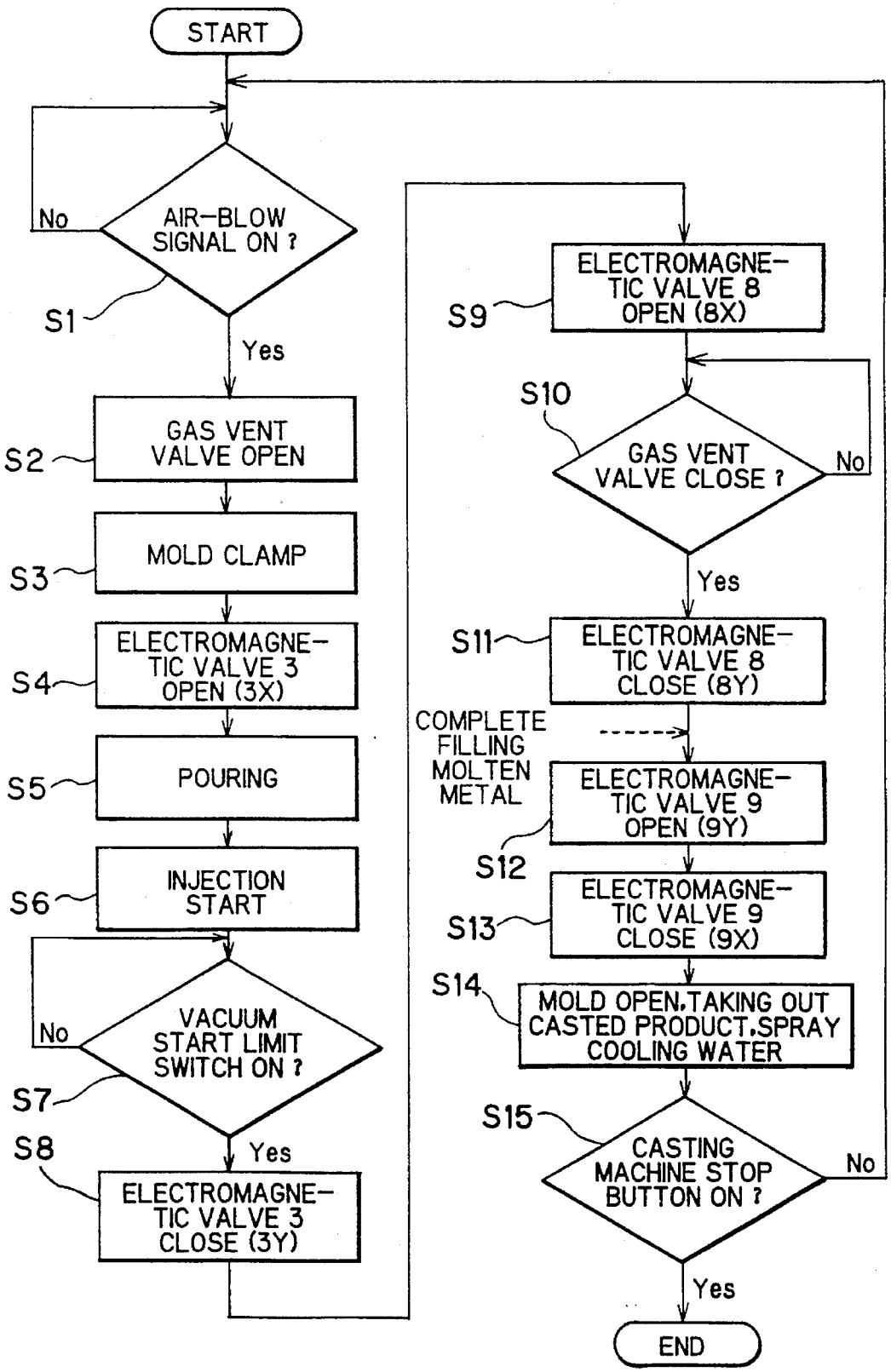
FIG. 2 is a flowchart showing a gas discharging process according to the present invention.

Next, gas discharging operation in the apparatus for discharging gas from the metal molds will be described with reference to a flowchart shown in FIG. 2.

Prior to the casting, the metal molds are open which is the last phase of the last shot cycle, and the gas vent valve 5 is closed. Further, the first electromagnetic valve 8 is positioned to its second change-over position 8Y where the gas vent valve 5 is disconnected from the vacuum tank 7. Furthermore, the second electromagnetic valve 3 is positioned at its second change-over position 3Y where the suction unit 1 and the gas vent valve 5 are disconnected from each other. Moreover, the third electromagnetic valve 9 is positioned at its first change-over position 9X where the gas exhaust line is disconnected from the atmosphere.

In Step S1, an air-blow signal is output, and in Step S2 a valve opening signal is outputted to the gas vent valve 5, and in Step S3 the metal molds are closed, and in Step S4 the second electromagnetic valve 3 is moved to its first change-over position 3X, In this state, the first electromagnetic valve 8 is positioned in its second change-over position 8Y and the third electromagnetic valve 9 is positioned in its first change-over position 9X. Thus, in the closure state of the metal molds, contaminated gas and moisture content in the metal molds are discharged by the suction unit 1 through the gas vent valve 5 and the second electromagnetic valve 3, and at the same time, external air is introduced into the metal molds through the pouring port 16, so that the contaminated gas in the mold cavity 13 is replaced with air. Thus, before casting, scavenging is performed where contaminated gas in the metal molds are positively discharged out of the mold cavity.

Next, in Step S5, molten metal is poured through the pouring port 16, and in Step S6, injection is started upon transmission of a drive signal to the injection cylinder 19. In accordance with the advancing movement of the plunger tip 17, the striker 18 moves forward,and in Step S7, the plunger tip 17 closes the pouring port 16 and abuts the vacuum start limit switch 20 to turn ON the switch 20. As a result, in Step S8 the second electromagnetic valve 3 is moved to its second change-over position 3Y.

Upon start of the injection, the mold cavity 13 is gradually filled with high temperature molten metal. In this case, a release agent and residual cooling water in the metal molds will be converted into gas. In order to remove the newly generated gas, immediately after the change-over operation of the second electromagnetic valve 3 into the second change-over position 3Y, in Step S9, a change-over signal is transmitted to move the first electromagnetic valve 8 into its first change-over position 8X. Thus, decompression is started, so that the contaminated gas in the mold cavity 13 and the gas vent passage 14 is suckedly discharged and is introduced into the vacuum tank 7 through the gas vent valve 5 and the first electromagnetic valve 8.

That is, in Steps S7 through S9, after the pouring port 16 is closed by the plunger tip 17, the striker 18 abuts the vacuum start switch 20 to render the switch 20 ON, so that the second electromagnetic valve 3 is moved to its second change-over position 3Y for stopping suction by the suction unit 1. Immediately thereafter, the first electromagnetic valve 8 is moved to its first change-over position 8X to start decompression.

When the striker 18 abuts the high speed limit switch 21, the driving speed of the injection cylinder is increased to move the plunger tip 17 at high speed, to thus promote filling of the molten metal into the mold cavity. Then, in Step S10, the gas vent valve 5 is closed at a predetermined timing to prevent the molten metal from leaking therethrough. As a result, the molten metal filling is completed. After the closure of the gas vent valve 5, suction becomes moot, and therefore, in Step S11, the first electromagnetic valve 8 is changed-over to its second change-over position 8Y.

After the molten metal filling, in Step S12, the third electromagnetic valve 9 is changed-over to its second change-over position 9Y by the control circuit 10 for introducing atmospheric pressure into the gas exhaust line 4. After elapse of predetermined time period, in Step S13, the third electromagnetic valve 9 is changed-over to its first change-over position 9X. Then, in Step S14, the metal molds are open to take out the casted product, and cooling water is sprayed onto the metal molds, and the release agent is coated thereover. Then, in Step S15, judgment is made as to whether or not a casting stop button is rendered ON. If not (S15: No), the routine returns back to the Step S1 to repeat the same processing. If turned ON, the processing is finished.

In the above described operation, venting stop timing for the metal molds (valve closing timing of the second electromagnetic valve 3 in the Step S8) is responsive to the , ON operation of the vacuum start limit switch in the Step S7. However, this venting stop timing can be responsive to the injection start signal in the Step S6. In any event, the second electromagnetic valve 3 must be positioned to its second change-over position 3Y by the time the decompression starts with respect to the mold cavity 13.

Incidentally, the present invention is not limited to the above described embodiment, but various changes and modifications may be made within the technical scope described in claims.

According to a method and apparatus for discharging gas out of the metal molds in the present invention described above, since clean air-is introduced into the metal molds through the pouring port of the shot sleeve by continuously and forcibly discharging contaminated gas generated in the metal mold after the closure of the metal molds, vapor explosion due to moisture content is avoidable even if the molten metal is filled in the mold cavity in the subsequent step, and gas involvement and insufficient run can be obviated. In other words, since venting has already been performed at a phase prior to the injection molding step, density of gas containing moisture can be greatly reduced to a low level. Further, newly generated contaminated gas due to the filling of the molten metal can be discharged out of the metal molds by suction under negative pressure. Therefore, gas involvement and insufficient run can be avoided.

Moreover, since forcible gas discharge from the metal molds is performed through the gas vent valve, negative pressure flow directing toward the gas vent valve occurs in the metal molds, so that gas around the negative pressure flow is subjected to sucking. Accordingly, contaminated gas even at the dead end passage portion can be discharged out of the metal molds. Further, since continuous forcible discharge can be performed during casting and an initial phase of the injection molding, repletion of the gas in the metal molds is avoidable, and the contaminated gas can be replaced with clean air. In addition, since the suction unit 1 independent of the vacuum tank 7 is employed, vacuum casting can be performed regardless of the condition of the vacuum tank, and prolongation of the shot cycle can be prevented. That is, an extra step is not required such as scavenging the metal molds by the vacuum pump, and therefore, shot cycle can be shortened.

While the invention has been described in detail and with reference to the specific embodiment thereof, it would be apparent to those skilled in the art that various changes and modifications may be made therein without departing from the spirit and scope of the invention.

What is claimed is:

1. A method for discharging gas out of metal molds including the steps of:

opening a gas vent valve provided in a gas vent passage in communication with a mold cavity formed in said metal molds;

decompressing said mold cavity through a first suction means via said gas vent valve for discharging gas in said mold cavity to avoid gas involvement in a molten metal injected into said mold cavity; and venting said mold cavity by second suction means, independent of said first suction means, via said gas vent valve after closure of said metal molds and until said decompressing step is started for removing contaminated gas from said metal molds and for replacing the contaminated gas with fresh air at a phase prior to injection of said molten metal.

2. The method as claimed in claim 1, wherein said venting step comprises the step of introducing fresh air into said metal molds through a pouring port of a shot sleeve which receives a plunger for guiding said molten metal to said mold cavity.

3. The method as claimed in claim 2, wherein said venting step is performed until a vacuum start limit switch, activated by said plunger, is turned ON.

4. The method as claimed in claim 3, wherein said decompressing step is started when said vacuum start limit switch is turned ON.

5. An apparatus for discharging gas out of metal molds having a mold cavity, a gas vent passage in communication with said mold cavity, and a gas vent valve disposed in said gas vent passage, said apparatus comprising:

first suction means for sucking gas in said mold cavity through said gas vent valve when said gas vent valve is open;

second suction means, provided independently of said first suction means, said second suction means being connected to said gas vent valve for forcibly venting said mold cavity when said gas vent valve is open; and control means connected to said first suction means and said second suction means for operating said first suction means immediately after said venting performed by said second suction means.

6. The apparatus as claimed in claim 5, wherein said first suction means comprises a vacuum pump, a vacuum tank and a first change-over valve connected between said vacuum tank and said gas vent valve, said first change-over valve being connected to said control means for selectively applying negative pressure into said metal molds.

7. The apparatus as claimed in claim 5, wherein said second suction means comprises a blower and a second change-over valve-connected between said blower and said gas vent valve, said second change-over valve also being connected to said control means for selectively applying negative pressure into said metal molds.

* * * * *